US007040959B1

(12) United States Patent
Panuska et al.

(10) Patent No.: US 7,040,959 B1
(45) Date of Patent: May 9, 2006

(54) VARIABLE RATE DISPENSING SYSTEM FOR ABRASIVE MATERIAL AND METHOD THEREOF

(75) Inventors: Brian R. Panuska, Phoenix, AZ (US); Joseph Hammer, Lexington, MN (US); Ronald Hammer, Forest Lake, MN (US); Wesley Bachman, Phoenix, AZ (US)

(73) Assignee: Illumina, Inc., San Diego, CA (US)

( * ) Notice: Subject to any disclaimer, the term of this patent is extended or adjusted under 35 U.S.C. 154(b) by 67 days.

(21) Appl. No.: 11/039,225

(22) Filed: Jan. 19, 2005

Related U.S. Application Data

(60) Provisional application No. 60/537,036, filed on Jan. 20, 2004.

(51) Int. Cl.
*B24B 1/00* (2006.01)

(52) U.S. Cl. ..... 451/36; 451/39; 451/40; 451/5; 451/102; 83/53; 83/177; 239/310; 239/318; 239/DIG. 8

(58) Field of Classification Search ..... 451/5, 451/36, 38, 40, 90, 102; 83/53, 177; 239/310, 239/318, 336, 340, 433, 434, 600, DIG. 8
See application file for complete search history.

(56) References Cited

U.S. PATENT DOCUMENTS

| | | | |
|---|---|---|---|
| 3,109,262 | A | 11/1963 | Weaver, et al. |
| 3,428,257 | A | 2/1969 | Kentfield et al. |
| 3,510,065 | A | 5/1970 | Gigantino et al. |
| 3,576,222 | A | 4/1971 | Acheson et al. |
| 3,737,108 | A | 6/1973 | Stumphauzer et al. |
| 3,796,371 | A | 3/1974 | Taylor, et al. |
| 3,843,055 | A | 10/1974 | Nord et al. |
| 4,236,674 | A | 12/1980 | Dixon |
| 4,346,848 | A | 8/1982 | Malcolm |
| 4,471,913 | A | 9/1984 | Hofmann |
| 4,555,872 | A | 12/1985 | Yie |
| 4,587,772 | A | 5/1986 | Griffiths |
| 4,627,573 | A | 12/1986 | Havens et al. |
| 4,669,760 | A | 6/1987 | Hashish et al. |
| 4,708,214 | A | 11/1987 | Krawza et al. |
| 4,711,056 | A | 12/1987 | Herrington et al. |
| 4,776,412 | A | 10/1988 | Thompson |
| 4,805,839 | A | 2/1989 | Malek |
| 4,817,874 | A | 4/1989 | Jarzebowicz |
| 4,819,388 | A | 4/1989 | Kirkland |
| 4,848,671 | A | 7/1989 | Saurwein |

(Continued)

*Primary Examiner*—Lee D. Wilson
*Assistant Examiner*—Anthony Ojini
(74) *Attorney, Agent, or Firm*—John T. Murphy

(57) ABSTRACT

An abrasive jet apparatus is provided which includes an abrasive dispenser defining a compartment for storing a granular abrasive material and at least one metering orifice disposed in open communication therewith for dispensing the granular abrasive material. The apparatus also includes a shutter assembly disposed adjacent the metering orifice, which includes a shutter member angularly displaceable between first and second positions relative to the metering orifice. The shutter member has formed therethrough at least one shutter opening which in the first position is substantially fully aligned with the metering orifice, and in the second position is substantially fully offset therefrom. The apparatus further includes a position actuator operatively coupled to the shutter mechanism for reversibly displacing the shutter member to the first and second positions and a plurality of intermediate positions therebetween for occluding a selective portion of the metering orifice. A flow rate of the abrasive material dispensed through said metering orifice is thereby maintained at a predetermined level.

20 Claims, 15 Drawing Sheets

U.S. PATENT DOCUMENTS 4,854,091 A 8/1989 Hashish et al.
4,913,353 A 4/1990 Myers
4,936,059 A 6/1990 Hashish et al.
4,951,429 A 8/1990 Hashish et al.
4,957,242 A 9/1990 Schadow et al.
5,018,317 A 5/1991 Kiyoshige et al.
5,018,670 A 5/1991 Chalmers
5,046,668 A 9/1991 Ikeuchi et al.
5,052,624 A 10/1991 Boers et al.
5,054,249 A 10/1991 Rankin
5,060,869 A 10/1991 Bekius
5,092,085 A 3/1992 Hashish et al.
5,144,766 A 9/1992 Hashish et al.
5,170,946 A 12/1992 Rankin
5,209,406 A 5/1993 Johnson
5,209,446 A 5/1993 Kawai
5,320,289 A * 6/1994 Hashish et al. ..... 239/434
5,341,608 A 8/1994 Mains, Jr.
5,365,816 A 11/1994 Rudy
5,390,450 A 2/1995 Goenka
5,469,768 A 11/1995 Schumacher
5,494,124 A 2/1996 Dove et al.
5,551,909 A 9/1996 Bailey
5,607,109 A 3/1997 Von Berg
5,626,508 A 5/1997 Rankin et al.
5,704,825 A 1/1998 LeCompte
5,765,578 A 6/1998 Brandt et al.
5,782,673 A 7/1998 Warehime
5,785,258 A 7/1998 Akin et al.
5,785,582 A 7/1998 Stefanik et al.
5,851,139 A 12/1998 Xu
5,860,849 A 1/1999 Miller
5,868,323 A 2/1999 Cantor
5,878,966 A 3/1999 Asakawa et al.
5,881,558 A 3/1999 Kawahara et al.
5,881,958 A 3/1999 Asakawa et al.
5,921,476 A 7/1999 Akin et al.
5,975,431 A 11/1999 Harita et al.
5,992,404 A 11/1999 Bleyer et al.
5,992,763 A 11/1999 Smith et al.
6,012,653 A 1/2000 Gunther et al.
6,036,116 A 3/2000 Bui
6,062,957 A 5/2000 Klaft et al.
6,065,683 A 5/2000 Akin et al.
6,077,152 A 6/2000 Warehime
6,119,964 A 9/2000 Lombari
6,123,413 A * 9/2000 Agarwal et al. ..... 347/47
6,126,524 A 10/2000 Shepherd
6,155,245 A 12/2000 Zanzuri
6,161,781 A * 12/2000 Kojima et al. ..... 239/533.12
6,168,503 B1 1/2001 Pao et al.
6,280,302 B1 * 8/2001 Hashish et al. ..... 451/102
6,283,832 B1 9/2001 Shepherd
6,293,857 B1 9/2001 Allard
6,425,805 B1 7/2002 Massa et al.
6,530,823 B1 * 3/2003 Ahmadi et al. ..... 451/39
6,752,685 B1 6/2004 Ulrich et al.
6,846,221 B1 1/2005 Ulrich et al.

* cited by examiner

VARIABLE RATE DISPENSING SYSTEM FOR ABRASIVE MATERIAL AND METHOD THEREOF

REFERENCE TO RELATED APPLICATIONS

This Utility Patent Application is based on Provisional Patent Application No. 60/537,036, filed 20 Jan. 2004.

BACKGROUND OF THE INVENTION

1. Field of the Invention

The present invention relates to abrasive jet machines used to cut or otherwise machine process various materials by generating a focused stream of fluid mixed with abrasive particles. The present invention relates in particular, to abrasive jet machines which use a pressurized liquid as the driving fluid to propel the abrasive particles for cutting or other machining operation.

The present invention is further related to an abrasive waterjet apparatus with a variable flow rate of an abrasive material to be entrained within the given fluid jet, wherein the flow rate is adaptively modulated to suit a particular operation of such apparatus.

Also, the present invention is related to an abrasive jet apparatus having an automatically controlled metering orifice for the abrasive dispenser, whereby flow rate of the abrasive material dispensed therethrough is adaptively regulated over a broad range of applications of the abrasive jet apparatus without operator intervention.

2. Prior Art

Abrasive waterjet cutting is a machining process where a focused ultrahigh velocity waterjet is used to accelerate abrasive particles which perform cutting. The high velocity waterjet is formed by pumping a fluid, such as for example, water to high pressure through a small diameter orifice. The resulting mixture of abrasive particles and water is discharged through a focusing tube as a high velocity composite jet to perform cutting or milling upon a workpiece.

In abrasive waterjet cutting, a water flow orifice restricts and accelerates the flow of high pressure water, typically at approximately 50 KSI to 65 KSI. This high speed jet of water is capable of cutting through various materials with relative ease. For metals, ceramics and other such materials, abrasives are added to the jet to increase the tribologic effect.

Abrasive waterjets typically employ a mini-hopper abrasive dispenser that is in turn fed by a large pressurized bulk hopper. Different sizes of abrasive materials (typically garnet having a mesh size within an approximate range of 80 to 220 mesh) are available for use with abrasive waterjets. An operator selects the abrasive size suitable for the material, thickness, finish, and other such parameters of the given workpiece, and sets the appropriate flow rate for the abrasive material which matches the size of the water flow orifice and focusing tube.

A typical abrasive waterjet apparatus 10 known in the art is illustrated in FIG. 1. The abrasive waterjet apparatus 10 includes a large pressurized bulk hopper 12 supplying an abrasive material to a mini-hopper abrasive dispenser 14. Presently known mini-hopper dispensers use a fixed or manually selectable metering orifice 16 such as a disk of preselected washer shape, or of manually adjustable aperture. A mechanical member 18 is used with the metering orifice 16 for occlusion against the flow of abrasive material therethrough. Typically, a pneumatic device such as a cylinder that responds to air pressure from a solenoid valve is used to actuate an abrasive valve mechanism 22 in this regard.

The abrasive material flow 20, having been regulated by the metering orifice 16 and admitted by the abrasive valve 22, freefalls until it meets an air jet 24. Shortly after passage by the abrasive valve 22, the abrasive material transitions from a freefall state to one of entrainment within a high speed air jet, forming an air/abrasive flow 26. The air/abrasive flow 26 is inducted into a waterjet mixing chamber 28 at a partial vacuum, and enters a mixing (or focusing) tube 30 where it contacts and mixes with the high speed waterjet. A highly focused abrasive/waterjet 32 is then expelled from the focusing tube 30 toward the workpiece 36 to be processed. Abrasive material size and flow rate are chosen in light of the specific operation to be performed upon that particular workpiece 36.

Note that the abrasive flow rate used for such machining operations as light material removal may not be sufficient for punching a hole or slicing through a thick section of the workpiece material. The operation may become overly time consuming, among other things. Conversely, a higher abrasive flow rate usually employed for cutting a thick section would not be appropriate for gently forming a delicate, sculptured shape. Presently known abrasive waterjet machines use either a fixed or manually selectable metering orifice that permits very limited control over the flow rate of the abrasive material, thus preventing optimal adaptation of the abrasive material flow rate, much less precise active control thereof. There is a need in the art, therefore, for a system and method whereby the mass flow rate of an abrasive material may be simply yet accurately adapted for assorted abrasive jet machining operations.

SUMMARY OF THE INVENTION

It is therefore an object of the present invention to provide an abrasive jet apparatus in which an abrasive material flow rate exiting an abrasive dispenser is regulated to adaptively suit the particular machining operation intended.

It is another object of the present invention to provide an abrasive jet apparatus wherein an opening of a metering orifice of the abrasive dispenser is actively adjusted by electrically driven positioning actuator in a manner corresponding to the type of machining operation intended and the type of a workpiece material to be processed in an accurate and reliable yet efficient manner.

It is a further object of the present invention to provide an abrasive jet apparatus which concurrently stores more than one abrasive material in the abrasive dispenser, and selectively dispenses the materials in flow rate controlled manner.

These and other objects are attained by a system and method realized in accordance with the present invention. In one exemplary embodiment, the abrasive jet apparatus comprises an abrasive dispenser defining a compartment for storing a granular abrasive material and at least one metering orifice disposed in open communication therewith for dispensing the granular abrasive material. The apparatus also includes a shutter assembly disposed adjacent the metering orifice, which includes a shutter member angularly displaceable between first and second positions relative to the metering orifice. The shutter member has formed therethrough at least one shutter opening that in the first position is substantially fully aligned with the metering orifice, and in the second position is substantially fully offset therefrom. The apparatus further includes a position actuator operatively coupled to the shutter mechanism for reversibly displacing the shutter member to the first and second positions and a plurality of intermediate positions therebetween for occluding a selective portion of the metering orifice. A flow rate of the abrasive material dispensed through said metering orifice is thereby maintained at a predetermined level.

DETAILED DESCRIPTION OF THE PREFERRED EMBODIMENTS

Figure 1:
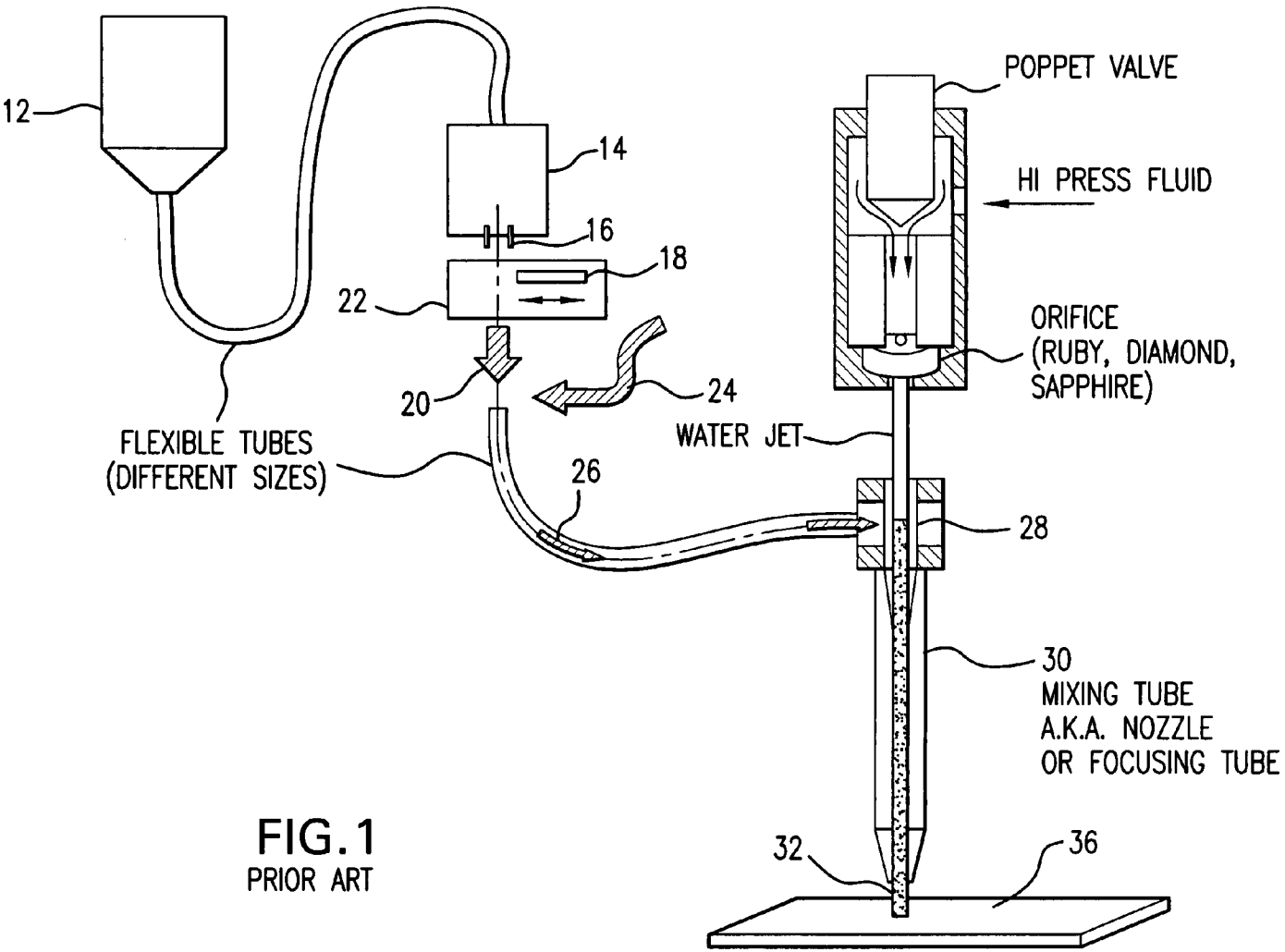
FIG. 1 PRIOR ART
FIG. 1 shows schematically a block diagram of an abrasive waterjet apparatus of the prior art.
Figure 2A:
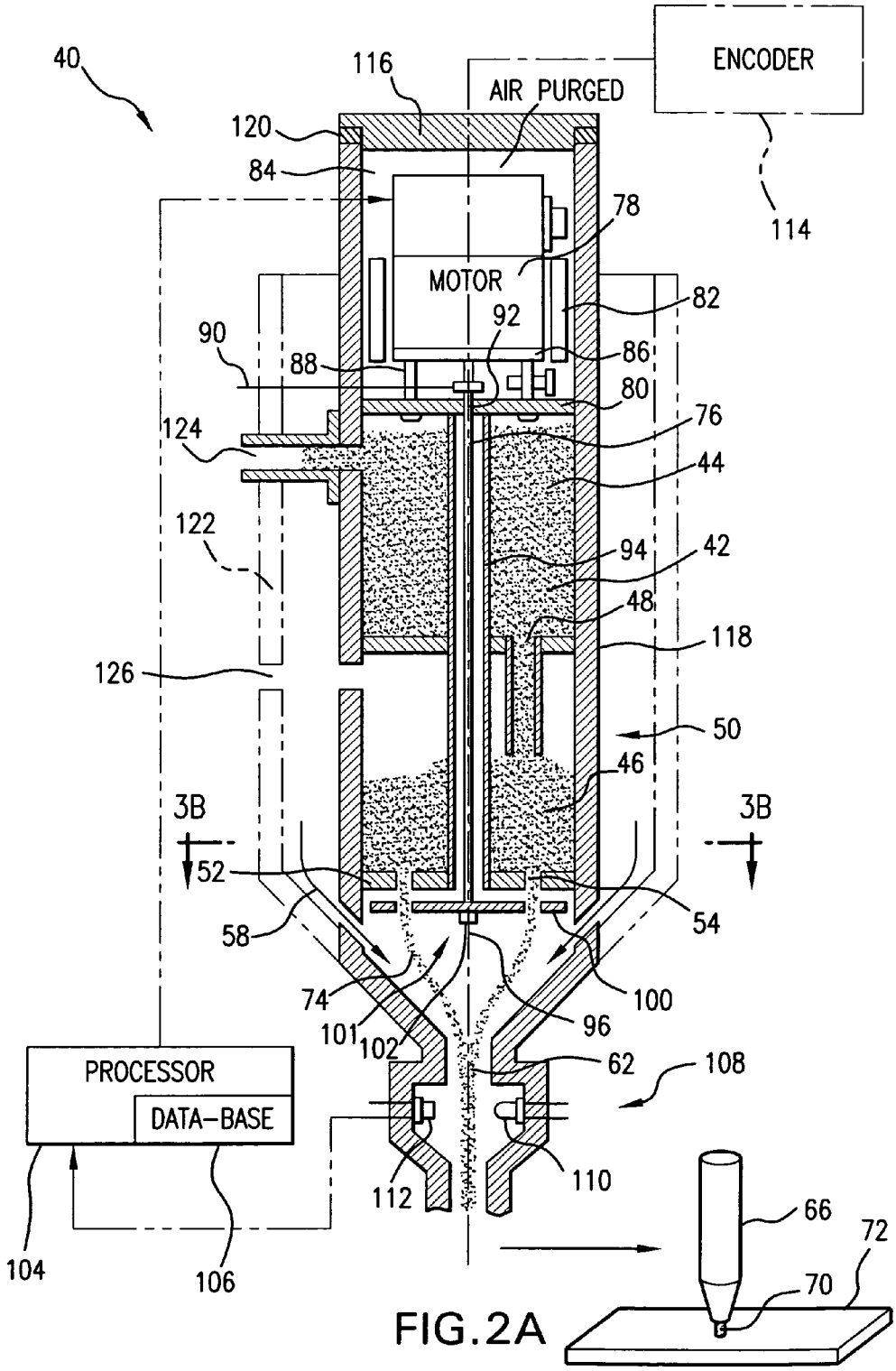
FIG. 2A is a sectional schematic view of one embodiment of an abrasive jet apparatus of the present invention.
Figure 2B:
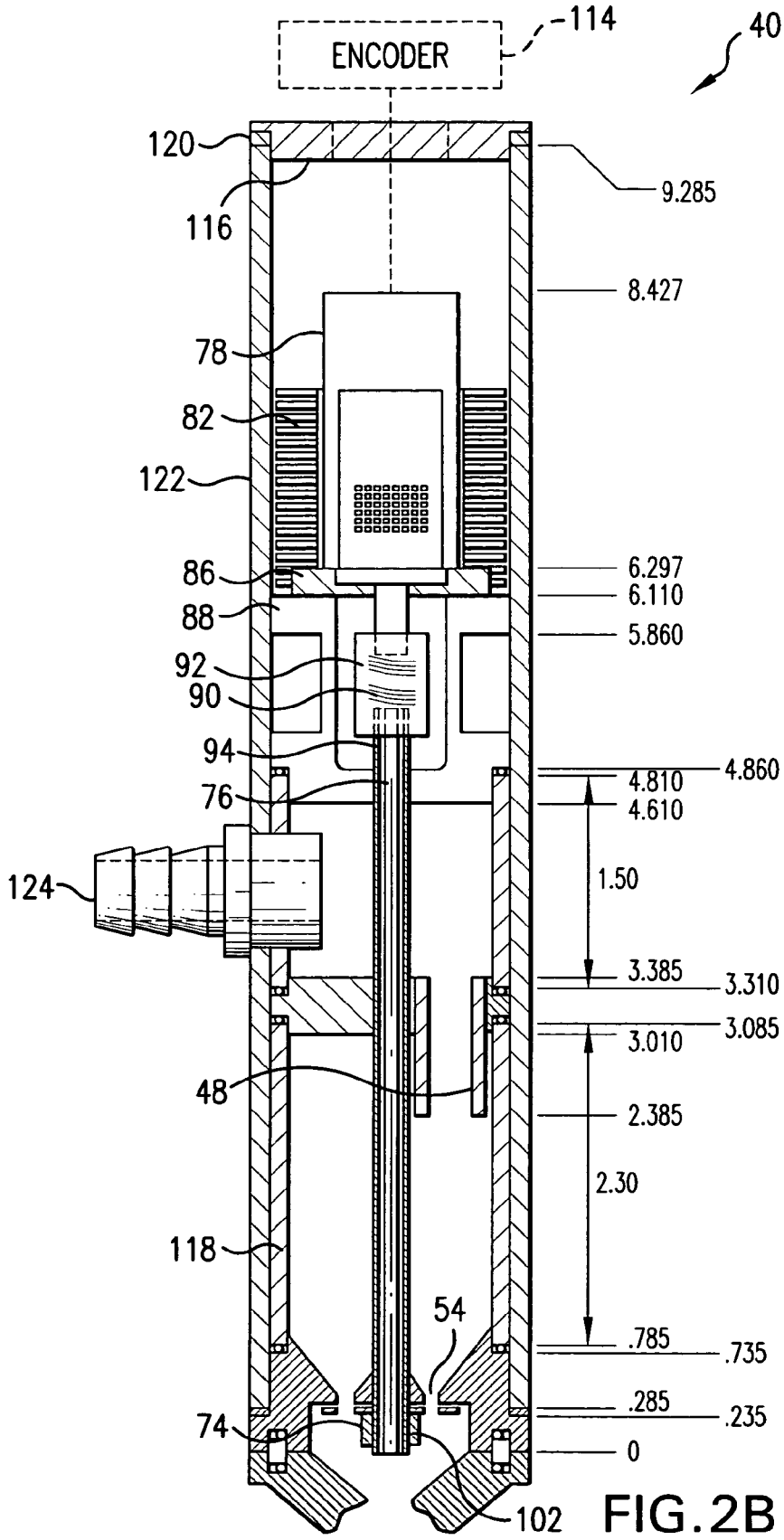
FIG. 2B is a sectional assembly schematic view corresponding to the embodiment of FIG. 2A, viewed from a perspective angularly offset from that of FIG. 2A, with certain structural and dimensional details illustratively shown.

Referring now to FIG. 2A, there is schematically shown an abrasive jet apparatus 40 formed in accordance with an exemplary embodiment of the present invention. A corresponding assembly drawing of the apparatus 40 adapted for a particular application, with certain exemplary dimensional parameters indicated for illustrative purposes, is shown in FIG. 2B. The abrasive jet apparatus 40 includes a hopper compartment 42 which receives and stores one or more abrasive materials 44 in granular form from an outside source (such as a separate bulk hopper) to supply an abrasive dispenser 46 through a passage 48. The abrasive dispenser 46 is preferably formed within a dispenser housing 50, the bottom wall portion 52 of which defines one or more metering orifices 54.

An automatically driven shutter assembly 74 is provided adjacent the bottom wall portion to selectively and variably occlude each metering orifice or a portion thereof. In broad concept, then, the rate of granular abrasive material 44 dispensed through a metering orifice 54 is actively controlled—and thereby suitably regulated for the cutting or other machining task at hand—by setting the shutter assembly to occlude a corresponding portion of that metering orifice 54, obviating the need to replace the orifice with one of another size/configuration, or to repeatedly open and close the orifice to control flow therethrough. As described in greater detail in following paragraphs, feedback control measures are preferably employed to actively monitor and adapt the degree of orifice occlusion, so as to dynamically maintain optimum flow rate for the abrasive material 44.

Figure 2C:
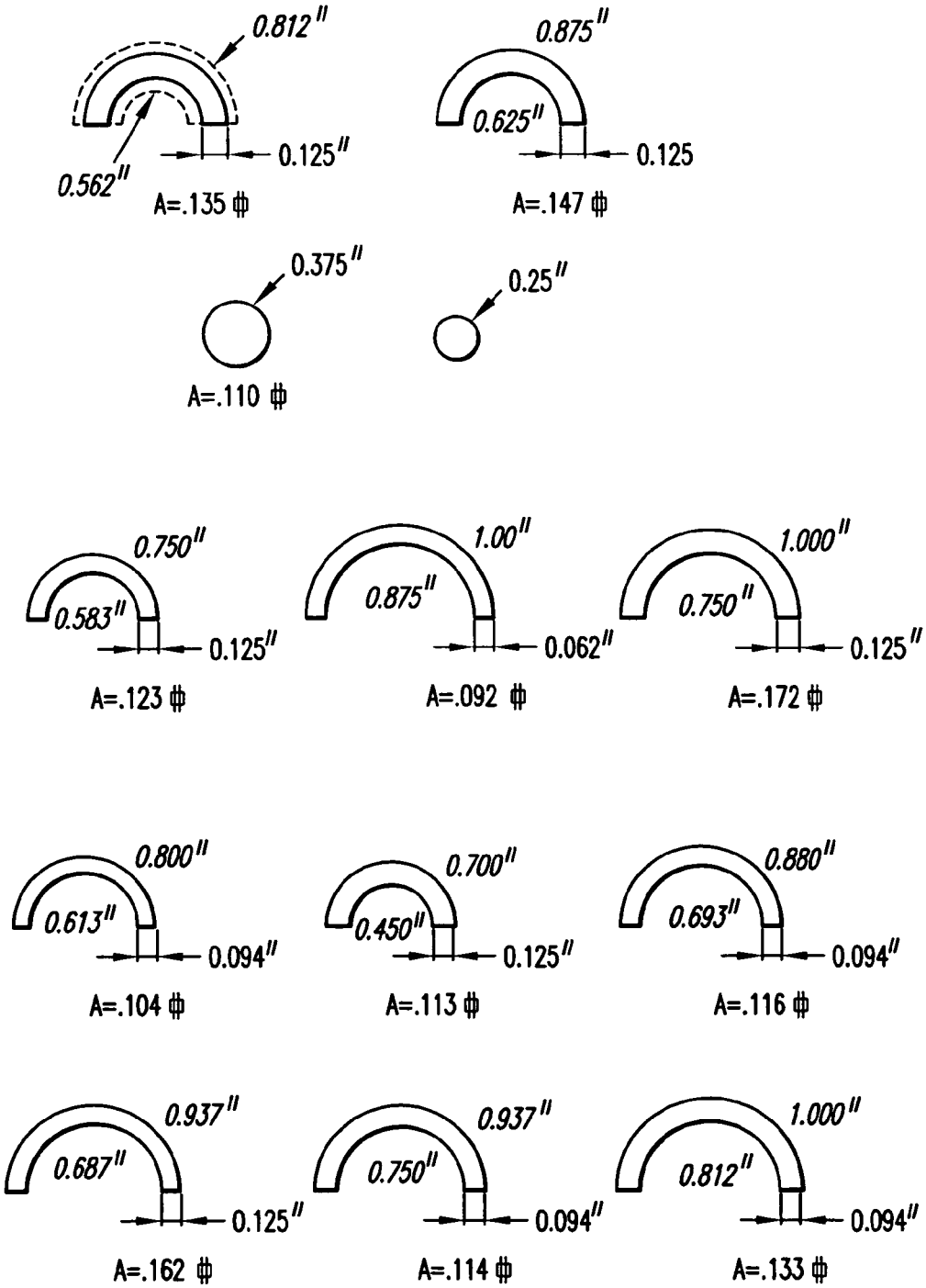
FIG. 2C shows schematically various examples of alternate embodiments for a portion of an abrasive jet apparatus of the present invention.
Figure 3B:
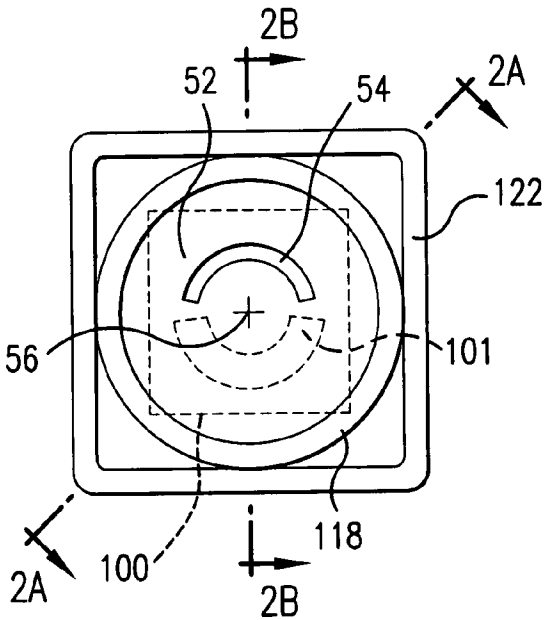
FIG. 3B is a sectional view taken also along line 3—3 of FIG. 2A, corresponding in part to the portion of the abrasive water jet apparatus shown in FIG. 3A.
Figure 3A:
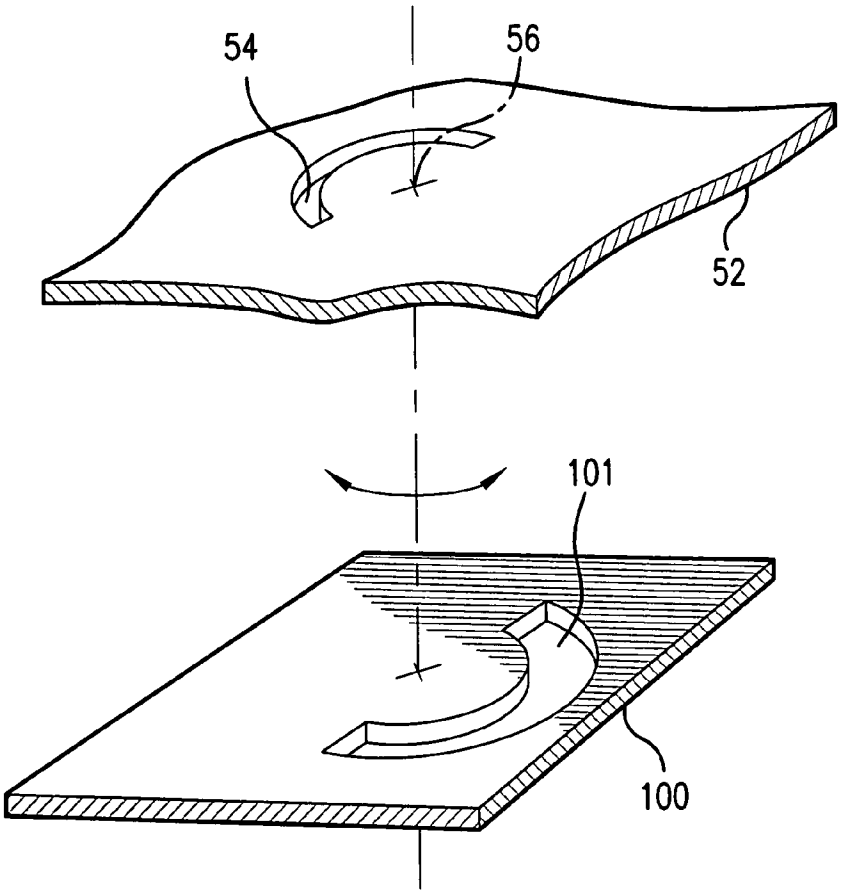
FIG. 3A is an exploded perspective view of a portion of the abrasive water jet apparatus shown in FIGS. 2A–2B.
Figure 4B:
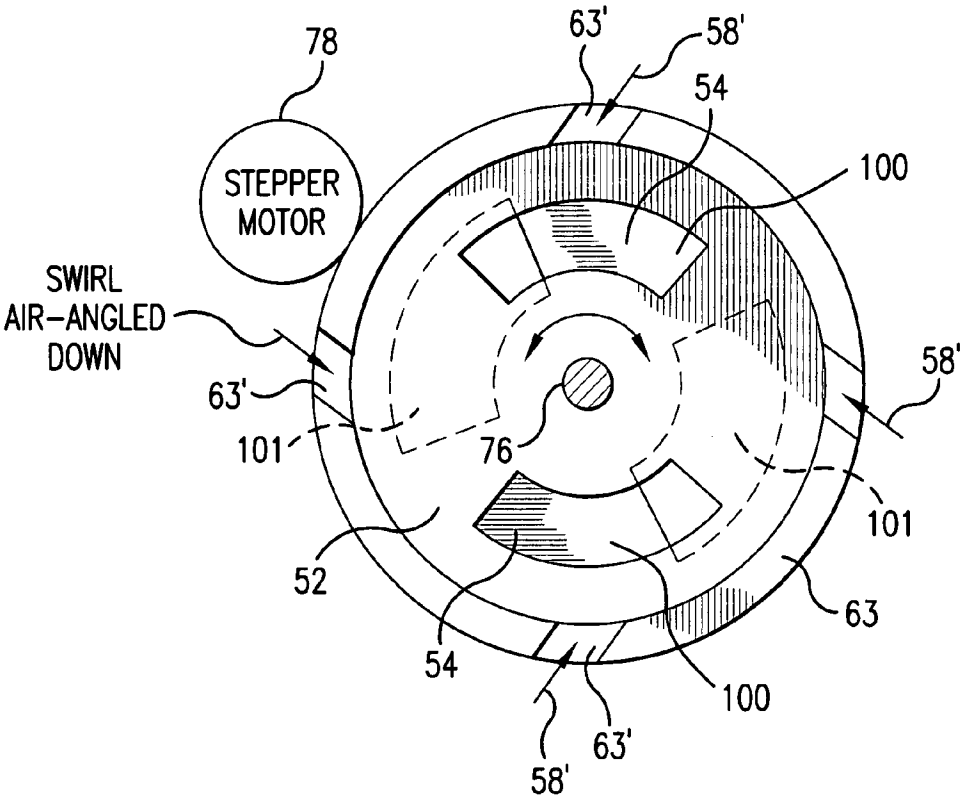
FIG. 4B is a sectional view analogous to that of FIG. 3B for the alternate embodiment shown in FIG. 4A.
Figure 4A:
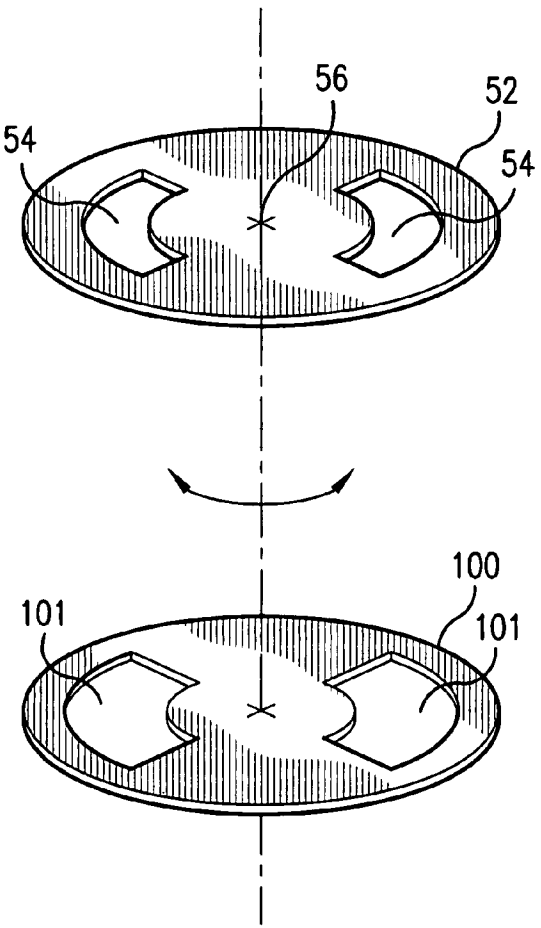
FIG. 4A is an exploded perspective view of an alternate embodiment of the portion of the abrasive water jet apparatus shown in FIG. 3A.

Though it may be formed in alternate embodiments with various other configurations suitable for the specific application intended, each metering orifice 54 is preferably configured in the exemplary embodiment illustrated as an arcuately contoured opening radially offset from, and extending in substantially concentric manner about, an axial reference 56 defined on the bottom wall 52, as best illustrated in FIGS. 3 and 4. The precise contour and dimensional configuration of the metering orifice 54 may be suitably adapted as required by the requirements of the intended application. FIG. 2C illustrates numerous examples wherein the metering orifice is arcuately contoured, and dimensional parameters are varied for different applications. Factors such as linearity of correlation between flow rate and portion of the orifice occluded, shearing of the granular material during shutter assembly operation about the orifice, and the like will bear on the actual choice of overall orifice configuration.

During operation, the abrasive material 44 is dispensed effectively in appropriate amounts by release through the non-occluded portion of metering orifice 54, as illustrated in FIG. 2A. The dispensed material 44 is then taken up in a high speed air jet 58, generated and directed about the dispenser housing 50 as shown, within an abrasive valve chamber 60. An air/abrasive mixture 62 thus forms, to be inducted into a waterjet nozzle 64 of the mixing chamber 66 where such abrasive/air mixture 62 mixes with, preferably, a high speed waterjet 68 for expulsion as a liquid/abrasive cutting jet 70. The cutting jet 70 exits the mixing chamber 66 for highly focused impingement upon a surface of a workpiece 72 to effect a cutting, milling, or other such machining operation thereon.

Depending on the type of operation to be performed on the workpiece 72, the abrasive material content—in terms of proportional content and granularity—in the liquid/abrasive cutting jet 70 may require variation to maintain optimum efficiency. For instance, a gentle sculpting or surface treating operation would tend to require a lower proportional content (and possibly even a finer grain) of abrasive material 44 in the cutting jet 70. On the other hand, a more rigorous operation such as punching a hole or slicing through a thick section of the workpiece 72 material would tend to require a higher proportional content (and possibly a courser grain) of abrasive material 44 in the cutting jet 70. In accordance with the present invention, the optimal flow rate necessary to preserve the desired abrasive material content in the cutting jet 70 is maintained by actively controlling shutter assembly 74 to suitably position a shutter 100 thereof to occlude an appropriate portion of the given metering orifice 54.

In order to increase the efficacy of the abrasive jet apparatus 40 in this manner during assorted abrasive jet machining operations upon the same workpiece 72, the shutter assembly 74 is automatically actuated by a drive shaft 76 preferably controlled by a servomotor 78. It is to be understood that instead of the servomotor 78, a stepper motor, voice coil, or any other suitable type of positioning actuator known in the art may be used in the abrasive jet apparatus 40.

The positioning actuator, further referred to herein simply as motor 78 (for brevity), is preferably positioned above the level of the abrasive material 44, such that it is safely protected from the particles of the abrasive material. As shown in FIGS. 2A and 2B, the motor 78 is preferably also disposed within a motor compartment 84 separated from the abrasive material 44 by a separating wall 80. Optionally, a heat sink 82 may be installed adjacent to the motor 78 within the motor compartment 84 to ensure sufficient heat dissipation. The motor 78 is positioned on a motor plate 86, mounted on a motor mount 88.

A drive shaft 76 is coupled to the motor 78 by means of a flexible shaft coupling 90 at an upper end 92 thereof, and extends axially through the abrasive dispenser 46. The drive shaft, too, is protected from potentially damaging contact the particles of the abrasive material 44 by a sleeve-like tubular shaft guide 94 through which it coaxially extends and within which it freely rotates.

The tubular shaft guide 94 acts as a loose bearing to support and restrain the drive shaft 76 coaxially along the axial reference 56. Preferably, the opposing surfaces of the shaft guide 94 and drive shaft 76 maintain sliding contact when the drive shaft 76 is rotated during operation. The shaft guide 94 and drive shaft 76 are, therefore, preferably formed of dissimilar materials particularly suitable for such relative sliding contact. For example, the shaft guide 94 may be formed of such material as stainless steel, with the drive shaft 76 itself being formed of such material as brass or anodized aluminum. Lower weight materials are preferable particularly for the drive shaft 76 to minimize inertial effects and thereby optimize rotational responsiveness to motor actuation (access times, for instance). Various materials known in the art may be employed in accordance with the present invention to best suit the specific requirements of the intended application.

The shutter assembly 74 is preferably coupled by a coupling collar 102 to a lower end 96 of the drive shaft 76. The assembly 74 is formed as shown in FIGS. 3A and 3B with a vane, or shutter, member 100 through which one or more shutter openings 101 are formed. Each shutter opening 101 is configured and positioned in a manner corresponding to one or more of the metering orifices 54. That is, each shutter opening is formed with a contour similar to that of the corresponding metering orifice(s) 54 but with a greater dimensional configuration than that of the corresponding metering orifice(s) 54. Thus, when the shutter member 100 is set in its angular position to its fully OPEN position, the given shutter opening 101 fully exposes the corresponding metering orifice(s) 54, the boundaries of the shutter opening 101 remaining safely clear of the orifice periphery to minimize shearing or other such potentially detrimental effects that might otherwise occur as the abrasive material 44 exits through that orifice. When the shutter member 100 is alternatively set to its fully CLOSED position, the given shutter opening 101 is drawn safely away from the corresponding metering orifice(s) 54, and the shutter member's solid surface portion fully occludes that orifice. At any of its intermediate settings between these positional extremes, the shutter opening 101 occludes only a portion of the corresponding metering orifice(s) 54. Such partial occlusion, of course, varies in degree of occlusion with the angular displacement of shutter member 100 about the axial reference 56.

When the motor 78 is turned to an "ON" state, it actuates the drive shaft 76 which, in turn, rotates the shutter member 100 of the shutter assembly 74 in a controlled fashion. This adjusts the overlap between its shutter opening 101 and the corresponding metering orifice(s) 54, in order to control the flow rate of the abrasive material 44 through that metering orifice 54. As best shown in FIGS. 3A–4B, the shutter openings are preferably in the exemplary embodiment shown, with arcuate contour and offset from the shutter member's central axis. The shutter member may be rotated relative to the metering orifice 54 in both clockwise or counter-clockwise directions. This way, the metering orifice 54 can be quickly closed or opened to the necessary extent, whereby the abrasive material flow rate through the metering orifice 54 is dynamically regulated in accordance with the type of machining operation then being performed by the abrasive jet apparatus 40.

The shutter member 100 is preferably formed of a hard, abrasion-resistant material to withstand repeated frictional contact with the abrasive material 44. It is preferably formed of a blue-tempered spring steel material, although other suitable materials known in the art may be used. In one exemplary application of the disclosed embodiment, the shutter member 100 is formed, for instance, with its planar portion having a thickness of approximately 1/32 inch, exhibiting a representative hardness of C49–51. Such parameters will, of course, vary depending on the particularities of the intended application; and, they are set out for illustrative purposes only, the present invention not being limited in any way thereto.

Figure 5A:
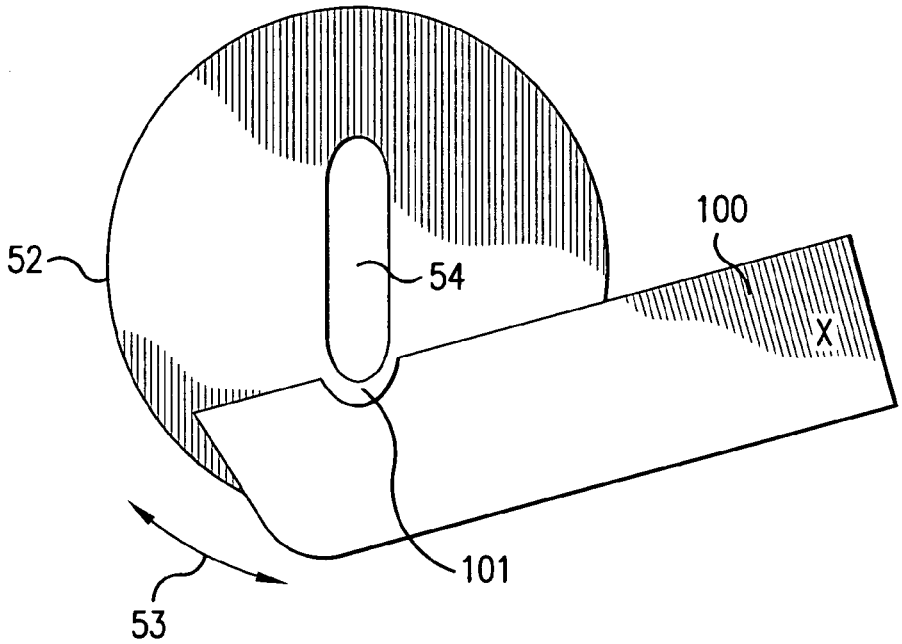
FIG. 5A is a schematic view illustrating another exemplary configuration of a metering orifice and adaptively displaceable shutter member used therewith, in accordance with another alternate embodiment of the present invention.
Figure 5B:
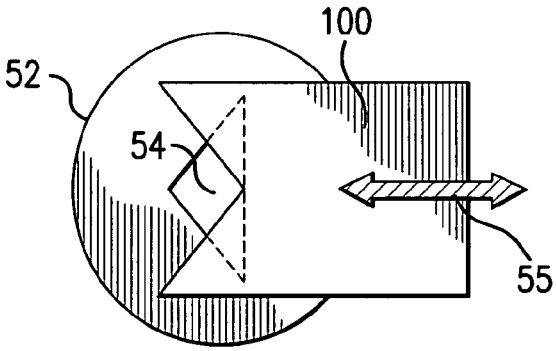
FIGS. 5B–5C are schematic views illustrating yet other exemplary configurations of a metering orifice and adaptively displaceable shutter member used therewith, in accordance with other alternate embodiments of the present invention.
Figure 5C:
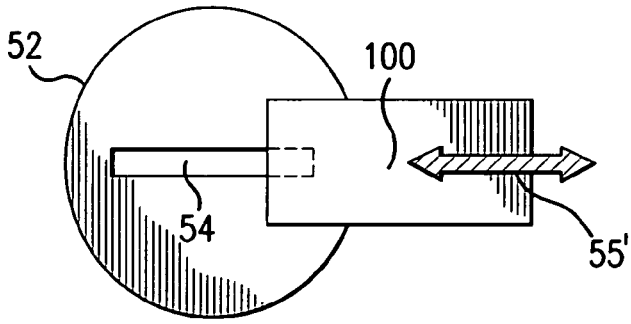

Turning next to FIGS. 5A–5C, there are schematically shown additional examples of numerous other configurations which may be employed for the shutter assembly 74 in accordance with certain other alternate embodiments of the present invention. In the embodiment of FIG. 5A, the metering orifice 54 is configured with a generally linear contour (an elongate slit), and the shutter member 100 is configured substantially as a pivotally displaceable elongate arm. A shutter opening 101 is provided at an upper edge of the shutter member 100 in the form of an arcuate notch coincident with an end edge contour of the elongate metering orifice 54. During operation, variable occlusion of the metering orifice 54 is effected by reversibly actuating pivotal movement of the shutter member 100 relative to thereto, along the direction indicated by the arrow 53.

In the embodiment of FIG. 5B, the metering orifice 54 and shutter member 100 form an intersecting-V configuration.

The metering orifice 54 is formed with a substantially triangular-shaped opening oriented relative to the direction of shutter member movement as shown, and the shutter member 100 is configured as a linearly translatable arm member having a corresponding V-shaped notch. During operation, variable occlusion of the metering orifice 54 is effected by reversibly actuating a linear movement of the shutter member 100 relative to thereto, along the direction indicated by the arrow 55.

The embodiment of FIG. 5C is similar to that of FIG. 5B, but with the metering orifice 54 and shutter member 100 contoured differently. Each is formed substantially with a rectangular contour relatively oriented as shown. The shutter member 100 is configured as a linearly translatable rectangular arm member which, during operation, is reversibly actuated to move along the direction indicated by the arrow 55' to effect variable occlusion of the metering orifice 54.

While these represent by example other viable configurations for the shutter assembly 74, the ease with which linearity between the degree of orifice occlusion and the resulting abrasive material flow rate may be realized varies with the configurations. In this regard, the arcuate metering orifice configuration disclosed herein offers notable advantages, as described in following paragraphs (with reference to FIG. 8).

Figure 5D:
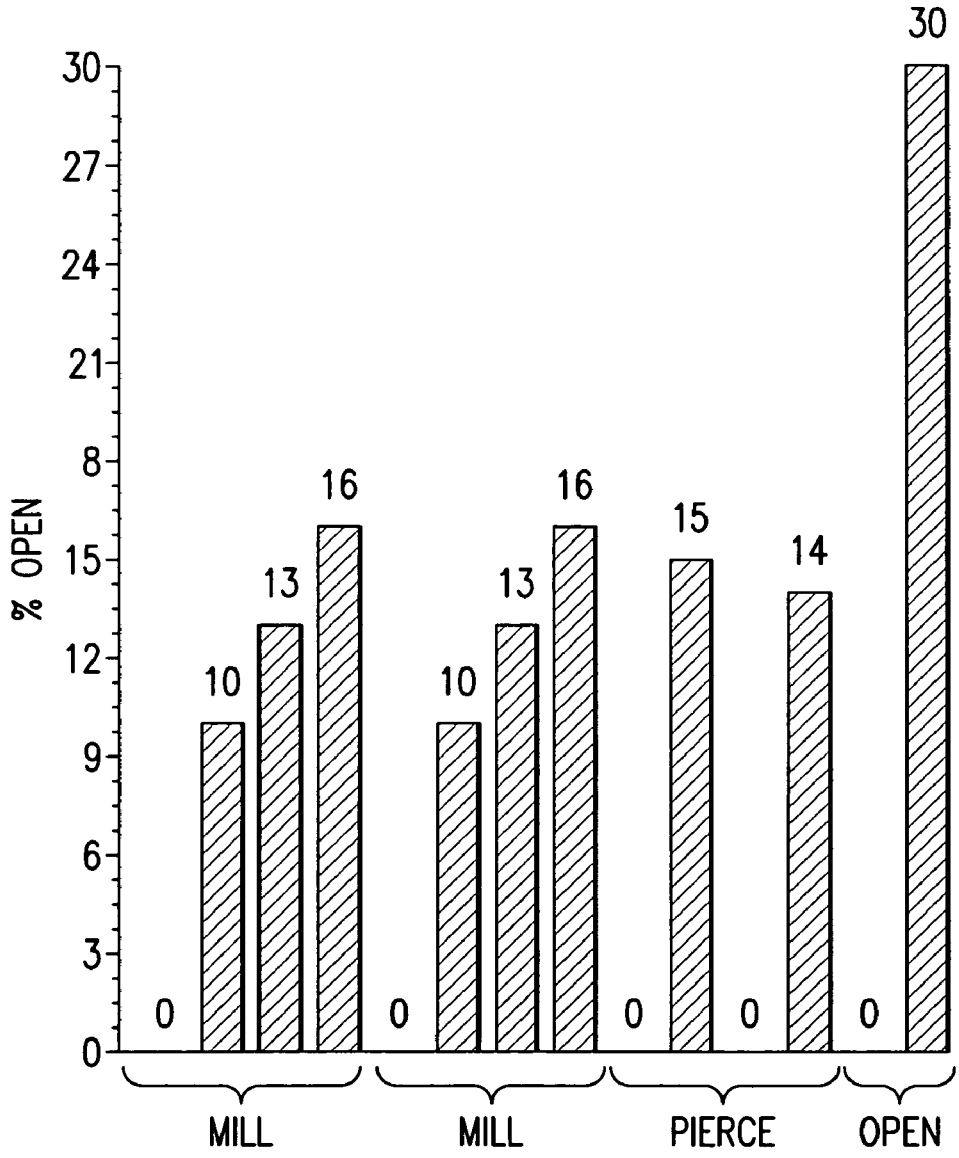
FIG. 5D is a graphic representation illustrating the relationship between the degree of occlusion of a metering orifice and the type of machining operation of the apparatus in one embodiment of the present invention.

FIG. 5D illustrates in chart form a representative profile of the degree to which the metering orifice 54 is ideally opened for different types of machining operations to be formed using an exemplary embodiment of the present invention, with a metering orifice configuration similar to that shown in FIG. 5A. The degree of overlap ideally required between a shutter opening 101 and its corresponding metering orifice 54 varies noticeably with the types of operation represented.

In accordance with the present invention, the abrasive jet apparatus 40 may employ a data processor 104 of any suitable type known in the art suitably programmed with a database 106 (or a look-up table, for example) or other known means by which the desired, or ideal, parametric values relating to the type of operation to be performed by the apparatus 40 and the required degree of metering orifice occlusion may be stored for ready access. Data processor 104, being operationally coupled to the motor 78, may control the operational parameters of the motor 78 accordingly, so that the opening of the metering orifice 54 is automatically controlled to maintain optimal abrasive material flow rate regulation during operation.

In accordance with another aspect of the present invention, the apparatus 40 preferably includes feedback control measures which employ an abrasive flow sensor 108 disposed at or near the mouth of abrasive valve chamber 60 through which the air/abrasive mixture 62 is expelled. Preferably, this sensor 108 a transmit/receive components such as a Light Emitting Diode (LED) 110 and a photo detector 112 optically coupled thereto. In the embodiment shown, these components are positioned at diametrically opposed sides of the abrasive/air mixture 62 flow to monitor for variation. A detection output generated by the photo detector 112 is coupled to the processor 104 for appropriate control processing. Depending on the flow data indicated by this detection output, the processor 104 adjusts the operation of the motor 78 to either open or close the metering orifice 54 to the degree necessary to adjust the flow rate of the abrasive material and thereby maintain optimum cutting conditions.

Additionally, or alternatively, another type of the feedback measure may be implemented using an encoder 114 operationally coupled to the shutter assembly 74 to acquire and transmit to the processor 104 data indicating the relative disposition of the shutter member 100 and the metering orifice 54. Operational parameters of the motor 78 may then be adjusted based upon this data to effect appropriate abrasive material flow rate control, much as described in preceding paragraphs.

As shown in FIGS. 2A–3B, the abrasive dispenser 46 includes a ventilation cap 116 covering the motor compartment 84. The ventilation cap 116 is connected to an outer casing 118 of the abrasive dispenser 46, preferably by a case gasket 120. Additionally, an external spray shield 122 in the embodiment shown encapsulates the entire abrasive dispenser of the apparatus 40. It is preferably formed with generally a rectangular or other polygonal sectional contour, and preferably dimensioned relative to the outer casing's tubular periphery, such that it forms against the outer casing a plurality of axially extending paths through which the high speed air jet 58 may be directed to the point of abrasive material release. A coaxial arrangement of the outer casing 118 and spray shield 122 preferably employed in this manner is best illustrated in the sectional FIG. 3B, wherein the directional arrows 2A and 2B respectively indicate the angularly offset viewer perspectives relative to which the corresponding sectional views of FIGS. 2A and 2B are taken.

As with any structural component that directly contacts the abrasive material 44, the outer casing 118 is formed of a suitably strong, tough, and wear-resistant material. Examples of suitable materials for components such as the bottom wall 52, motor mount, and the hopper/dispensing compartment walls include stainless steel, a hard coat anodized aluminum, and the like. For the outer casing 118, a clear polycarbonate or other such material may be particularly suitable, as the abrasive material 44 contained therein would then remain visible for the operator. There is little practical likelihood of excessive erosive hazing on the interior surfaces when such materials are used, given that the abrasive material's kinetic energy which typically accounts most for erosive hazing remains minimal prior to dispensing.

The outer casing 118 is formed with an abrasive material feed port 124 for introduction of the abrasive material 44 into the hopper compartment 42 from an outside source, and a breather port 126 for the venting necessary to relieve the residual pressure urging the abrasive material 44 into the hopper compartment 42. The abrasive dispenser will thereby be at ambient pressure, and be released through the non-occluded portion of the metering orifice 54 sufficiently by gravity.

Figure 9:
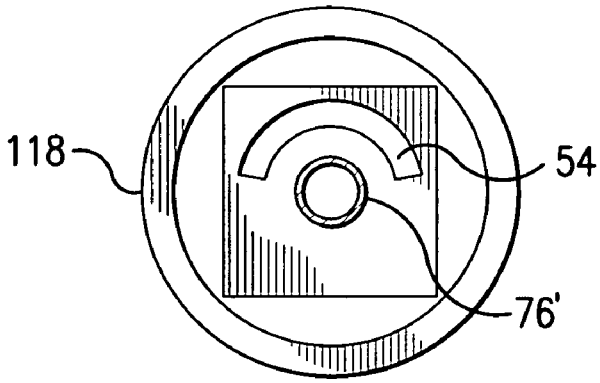
FIG. 9 is a sectional view in an alternate embodiment of a portion of the abrasive water jet apparatus otherwise shown in FIG. 2A.

In certain alternate embodiments, drive shaft 76 acts both as an aspiration conduit as well as a torque communicating member between the motor 78 and shutter assembly 74, it concurrently serves as the aspiration conduit through which the high speed air jet 58 is directed. As shown in FIG. 9, the drive shaft is formed in this embodiment as a hollow lightweight drive tube 76'. The drive tube 76' then defines an axial bore which serves sufficiently to conduct the high speed air jet 58 induced during operation.

To minimize destabilizing inertial effects, this drive tube 76 is preferably formed of a material of any suitable type known in the art having minimal weight yet sufficient strength and durability to effectively withstand the torsional forces to be encountered in the intended application. While not shown for clarity, a guide shaft tube 94 is preferably disposed coaxially about the drive shaft/tube 76' much as it is in the embodiment described in preceding paragraphs. The guide shaft tube 94 accordingly serves not only as a protective barrier for the drive tube 76', it acts as a loose bearing to support and restrain the drive tube 76' coaxially along the axial reference 56.

The flexible coupling 90 by which the drive tube 76' is coupled to the drive actuating motor 78 is preferably of a helical coupling type such as made available by MCMASTER-CARR. Typically, such helical couplings are formed with generally cylindrical outer walls in which a plurality of helical cuts (or surface grooves) are provided to accommodate a certain degree of flexion without undue compromise of torsional stiffness. The high speed air jet 58 induced during operation through the drive tube 76' in this embodiment is preferably drawn through the space defined by the helical cuts themselves.

A notable advantage provided by this embodiment is that the abrasive material 44 is caused to be entrained in the air jet 58 more immediately upon release from the abrasive dispenser 46. Another advantage is one of structural simplicity, obviating the need for extraneous structural measures otherwise incorporated in other embodiments (such as a spray shield 122 for defining a path about the outer casing 118) for directing the high speed air jet 58 to the point of abrasive material release.

In this as well as other embodiments disclosed herein, an advantage inhering in the concentric rotational movement preferably employed to adaptively adjust the shutter member 100 is that both the shutter member 100 and its drive shaft 76 (or drive tube 76') naturally operate to clear themselves of abrasive material particles or other debris. The centrifugal force generated by these components' own concentric rotational movement serves to propel or cast away, in self-clearing manner, any such particles or debris that might collect thereon, otherwise.

In the alternate embodiment of FIG. 4, a pair of metering orifices 54 are formed and disposed as shown concentrically about the axial reference 56. Correspondingly, the shutter member 100 is provided with a pair of shutter openings 101 formed therethrough. In its fully open and closed positions, the shutter member 100 alternatively offsets and aligns its shutter openings 101 concurrently with the metering orifices 54. Where the configurations and relative positions of the metering orifices 54 are such that it becomes difficult to fully open or close one metering orifice 54 without adverse interfering effect upon the other, a plurality of separately displaceable coaxially disposed shutter members 100 may be suitably employed, though reliable yet not overly complex actuation means my be difficult to realize in practice.

As also shown in the embodiment of FIG. 4, a downwardly swirled aspiration pattern may be employed to facilitate entrainment of the dispensed abrasive material 44 with the high speed air jet 58. As shown, a plurality of downwardly angled inlet openings 63' may be formed in a sidewall portion 63 of a capsule member enclosing the air/abrasive mixture chamber 62. The inlet openings 63' are spaced in angularly offset manner one from the other, such that they collectively impart a swirling flow to the high speed air jet 58 passed into the chamber 62 therethrough.

Figure 6:
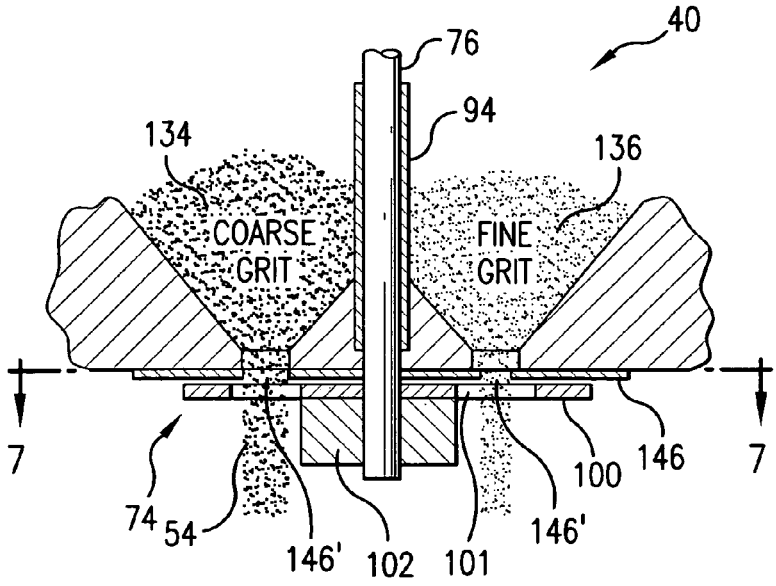
FIG. 6 shows schematically a portion of the abrasive jet apparatus formed in accordance with another alternate embodiment of the present invention, wherein multiple abrasive material compartments are formed.

Turning now to the alternate embodiment illustrated in FIGS. 5–6, the symmetry of the arcuate metering orifice 54 configured as shown lends itself to a two position manually adjusted hopper structure, from which two different abrasive materials 44 may be selectively dispensed. Using a combination of clockwise or counterclockwise rotation and stop movement of the shutter member 100, either of the two abrasive materials 44 would be dispensed in flow regulated manner, much as described in preceding paragraphs.

The dual abrasive hopper structure may be employed to dispense abrasive materials 44 of altogether different type, or more typically to dispense abrasive materials 44 of the same type, but having different granularity. For example, a garnet material having preselected course and fine mesh sizes (typically selected from an approximate range of about 80 to 220 mesh) may be stored and dispensed selectively from the hopper structure. This enables the resulting apparatus 40 to carry out bulk material removal/cuts just as readily as fine feature contouring operations on the same target workpiece 72, without pause for significant reconfiguration.

Figure 7:
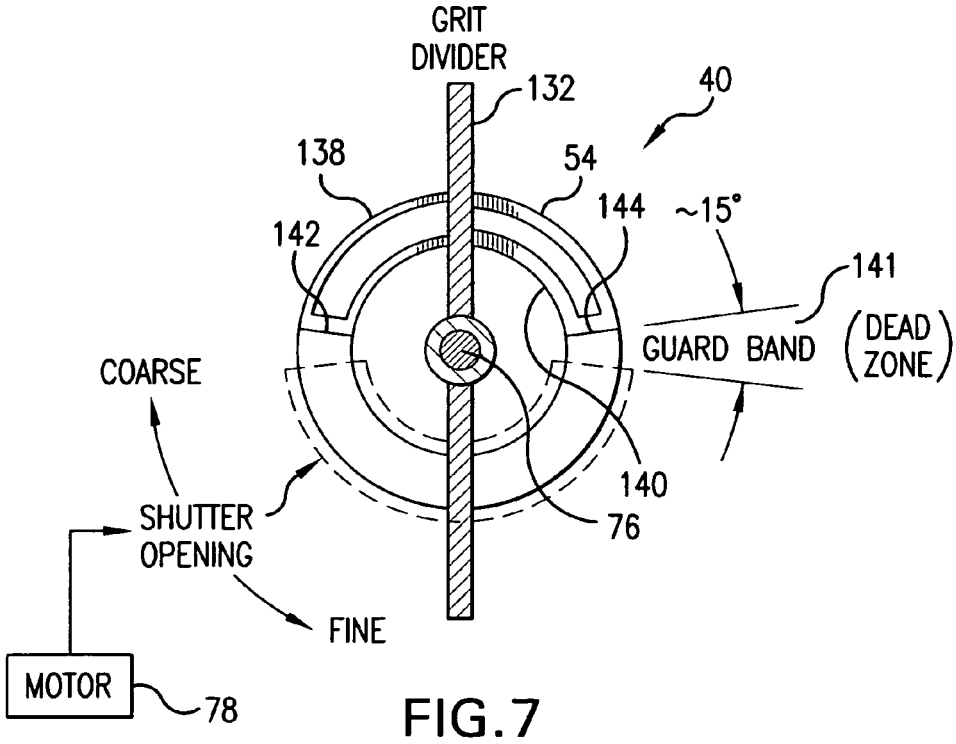
FIG. 7 is a sectional view of the embodiment of FIG. 6 taken along lines 7—7 thereof.

As shown in FIGS. 6 and 7, the dispenser housing in this embodiment 50 is separated by a divider member 132 in two compartments, a coarse abrasive material compartment 134 and a fine abrasive material compartment 136. Although two metering orifices can be used in this embodiment, e.g., one metering orifice for each compartment 134 or 136, a single arcuate metering orifice 54 is preferably employed. The metering orifice 54 extends beneath portions of both compartments so as to be effectively bisected by the divider member 132, as best shown in FIG. 7. One portion, or half, 138 of the metering orifice 54 serves as the metering opening for the coarse material compartment 134, while the other portion, or half, 140 of the metering orifice 54 serves as the metering opening for the fine material compartment 136 of the dispenser housing 50. The shutter member 100 is formed as shown with a shutter opening correspondingly configured and disposed thereon, such that when it is rotated by the drive shaft 76 in controlled manner clockwise or counterclockwise, it selectively closes or partially opens to the required degree one or the other of the metering orifice halves 138 and 140.

To guard against inadvertent leakage of abrasive material 44 through the metering orifice 54, a guard band region 141 is preserved between the metering orifice 54 and the shutter opening 101 of the shutter member 100. That is, the metering orifice 54 and the shutter opening 101 are so configured and positioned, respectively, that when they are disposed in the maximally offset positions (diametrically opposed positions in the embodiment shown), their nearest peripheral extremities remain at least a preset distance away from one another. For example, a pair of guard band regions 141 of approximately 15° in angular extent (about the axial reference 56) define dead zones, by which the shutter member 100 must be angularly displaced at the very least (from the maximally offset position) before any portion of its shutter opening 101 will overlap any portion of the metering orifice 54.

In this embodiment, a secondary metering arc restrictor 146 is shown coaxially disposed between the metering orifice 54 and the shutter member 100. Formed with any configuration suitable for the given orifice and shutter opening configurations, this secondary metering arc restrictor 146 effectively serves a static adjustment function. Much like the shutter member 100, the secondary metering arc restrictor 146 is formed with one or more openings 146' which partially occlude the given metering orifice 54 when appropriately aligned therewith. If, for instance, the granularity or material composition of the selected abrasive materials preclude use of the entire metering orifice 54 allocated thereto, the secondary metering arc restrictor 146 may be suitably set in position to restrict the orifice shape or size as needed. Dynamic control of the shutter member 100 may then proceed as in other embodiments, but with the metering orifice 54 so restricted.

In certain embodiments, this secondary metering arc restrictor 146 may be configured with an arcuate opening contoured and positioned relative to the axial reference 56 in much the same manner that the metering orifice might be configured and positioned in other embodiments. Angular displacement of the secondary metering arc restrictor 146 relative to the orifice 54 would then variy the position of the residual orifice segment for subsequent use. Use of such secondary metering arc restrictor 146 of this or other suitable configuration need not be limited to the embodiment of FIGS. 6–7, though the desirability of such may be particularly apparent in that embodiment.

In arrangements where the metering orifice 54 is contoured as an arc, the most significant nonlinearities occur at the ends 142 and 144 of that metering arc. In the middle section of the arc, each increment of the shutter member's motion (typically within 0.2° in positional accuracy, at an approximate 50 ms seek time) preferably uncovers/occludes substantially the same ratio of edge-to-cross-sectional area. As expected, the abrasive particles experience the most discernible shear forces near the edges 142 and 144 of the fixed arc, such discernible forces being largely absent near the middle of the arc. Therefore, by modifying the ends of the arc (for any given abrasive particle size), by a suitably compensating tapered shape for example, it is possible to diminish or eliminate the discontinuity of the end edge effect.

The metering arc 54 may thus be tailored for specific applications in numerous other respects. For example, the metering arc 54 may be configured such that a finer adjustment capability (for a given increment of shutter member motion) at one end of the arc graduates to a courser adjustment capability (i.e., much higher flow rate) at the other.

Figure 8:
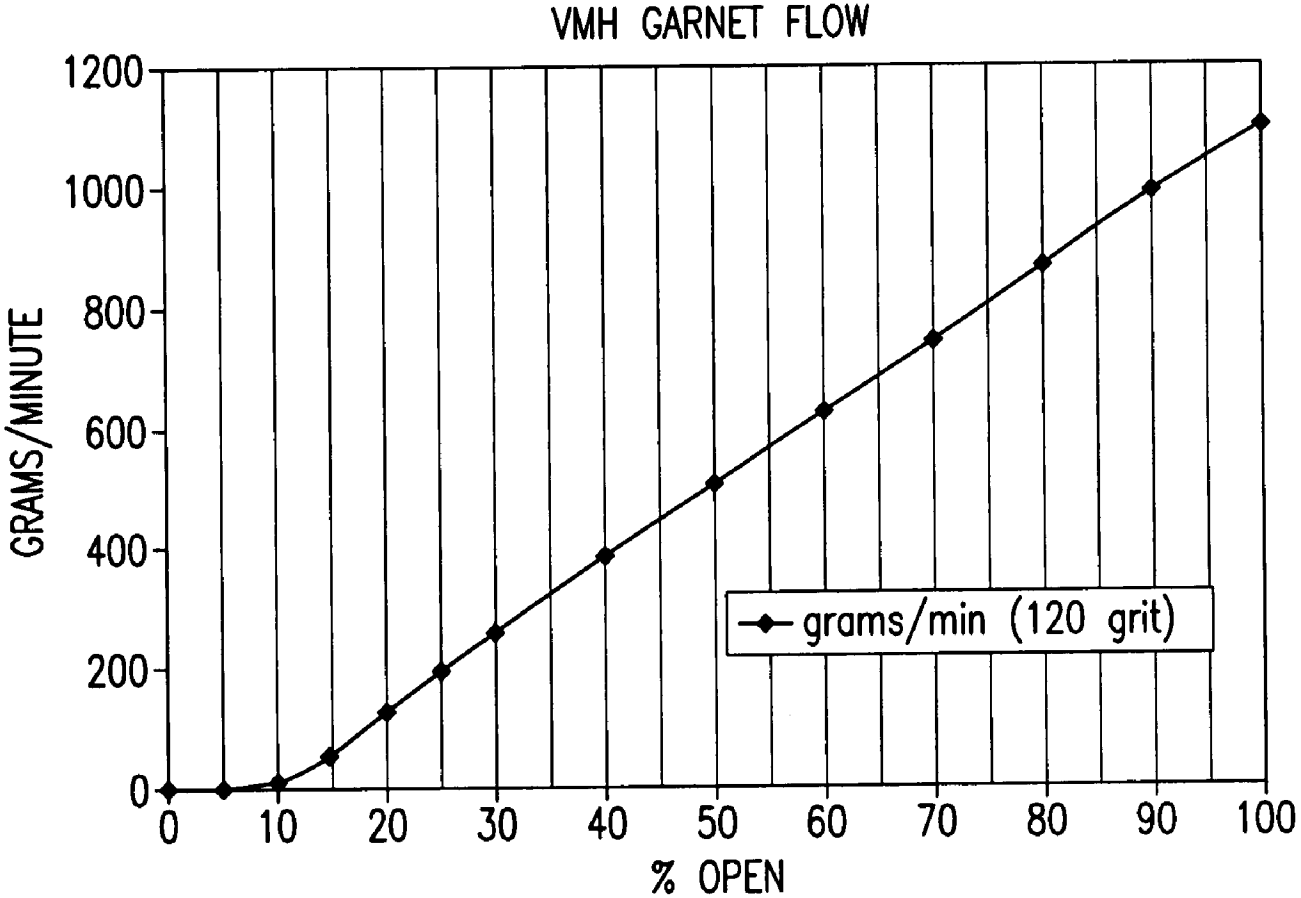
FIG. 8 is a graphic representation showing the relationship between the abrasive material flow rate and the degree of occlusion of a metering orifice in one embodiment of the present invention.

Referring to FIG. 8, an example of the flow rate realized by using the embodiment of FIGS. 2A–2B, with a metering orifice configuration similar to that shown in FIG. 3A is graphically illustrated. Over much of at least the intermediate points of operation shown, the relationship between measured flow rate and percentage of shutter open (or degree of occlusion) approaches perfect linearity.

It is worth mentioning that the shutter member 100 operates to itself occlude only along one edge of the abrasive flow through the metering orifice 54, such that shear effects are kept to a minimum. Also, a custom shaft collar 102 is preferably employed as shown in FIG. 2 to mate the shutter member 100 to the drive shaft 76. Preferably, a pinned plate arrangement is provided between the shaft collar 102 and the shutter member 100 so as to overcome any thermal problems which may occur in other arrangements.

Figure 10:
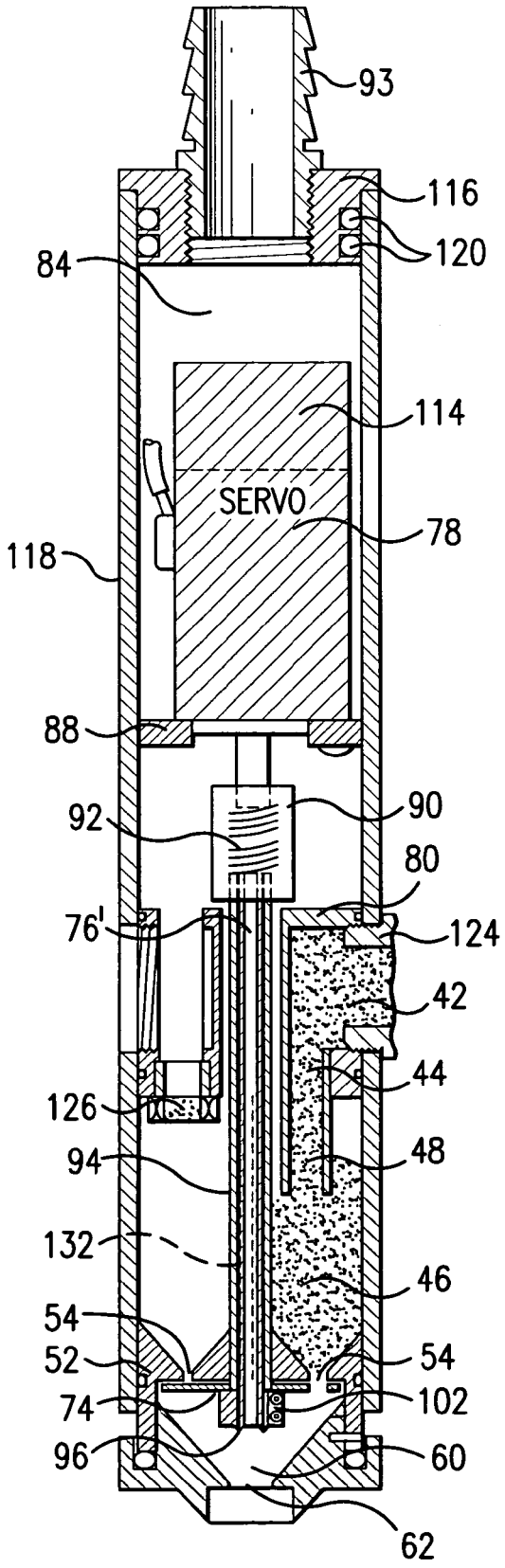
FIG. 10 is a broader sectional schematic view of a dual abrasive chamber embodiment of an abrasive jet apparatus of the present invention illustrated in FIGS. 6 and 7.
Figure 11:
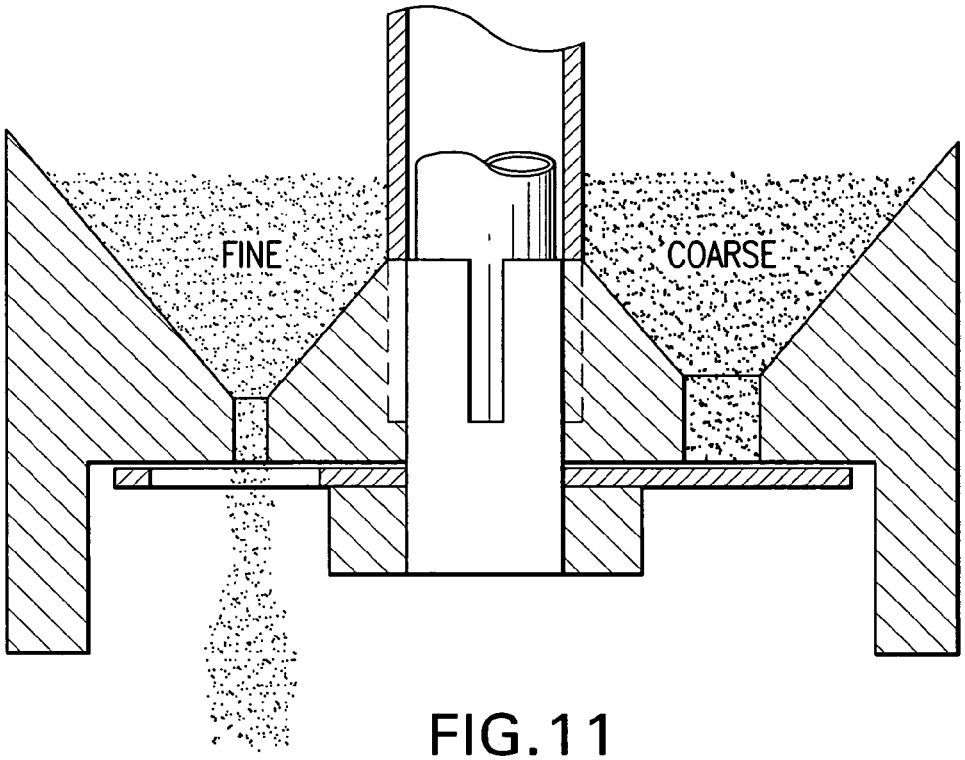
FIG. 11 is an enlarged view, partially cut away, of a portion of the sectional view shown in FIG. 10.

Referring now to FIGS. 10–11, the dual abrasive chamber embodiment of the abrasive jet apparatus 40 illustrated in FIGS. 6 and 7 is more fully shown. While minor variations are evident and some features are more clearly visible, the overall structure of this embodiment is similar to that shown in FIGS. 2A and 2B; and, analogous parts/components are denoted by like reference characters. In this embodiment, a coupling 93 is more clearly shown with a bore which accommodates the passage of encoder coupling connections to the motor 78, for example.

Figure 12:
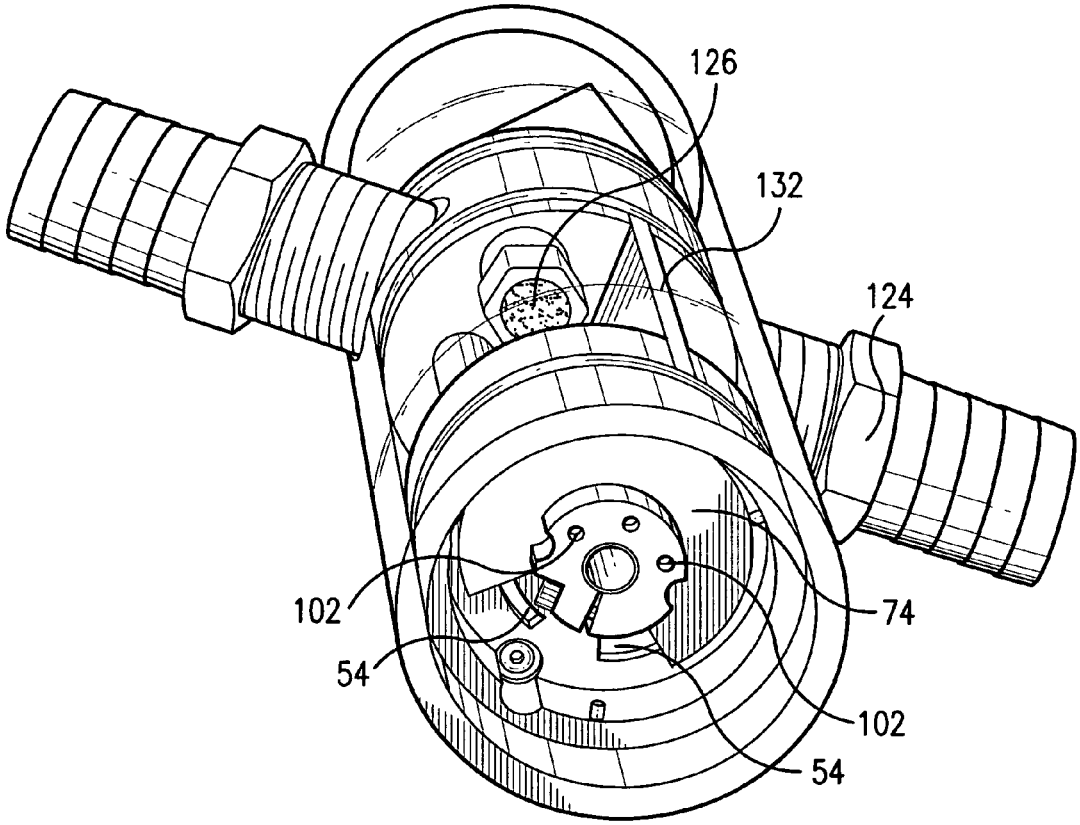
FIG. 12 is a bottom perspective view of a partially disassembled implementation of the embodiment shown schematically in FIG. 10; and, FIG. 13 is another perspective view of the implementation shown in FIG. 12.
Figure 13:
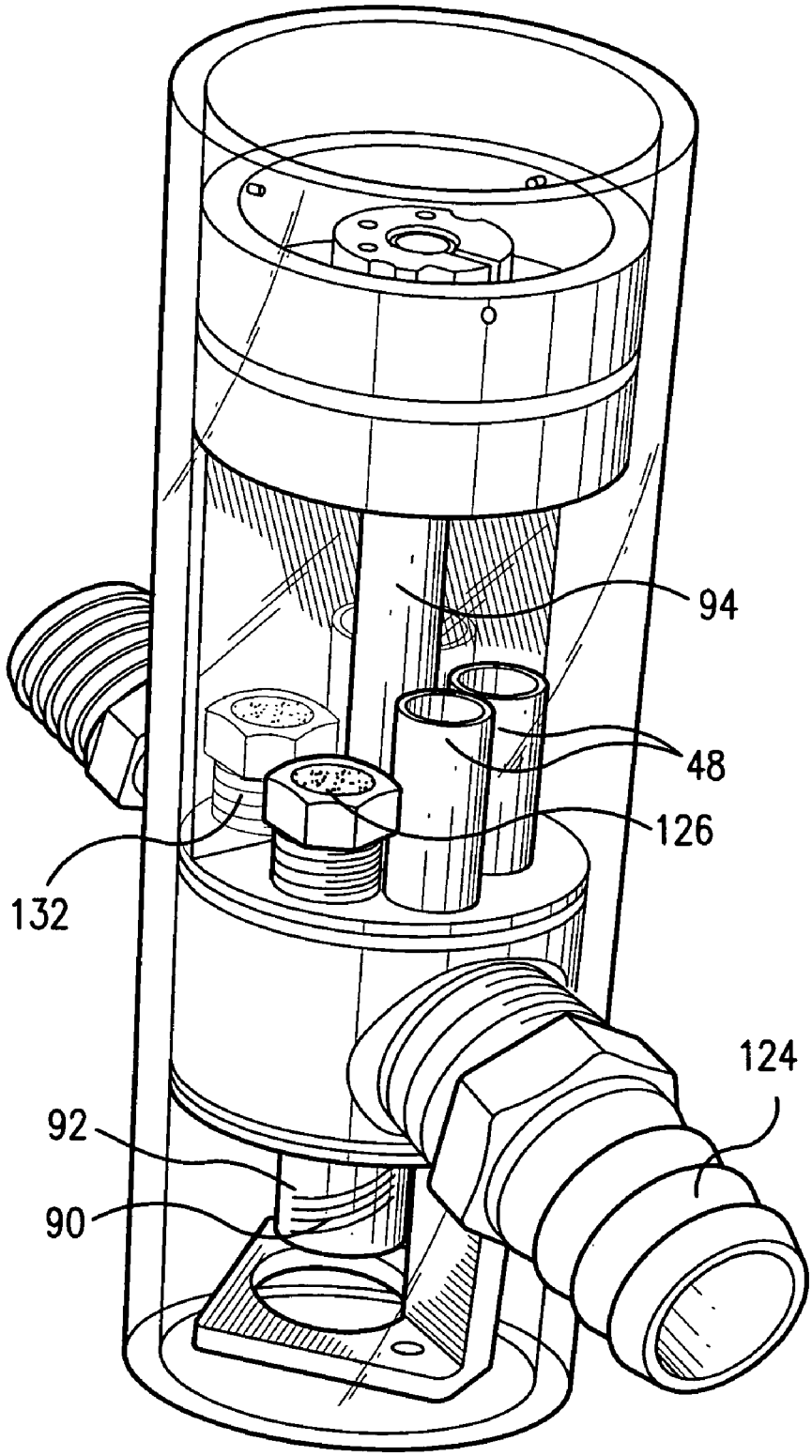

FIGS. 12–13 show perspective views of an exemplary implementation of the embodiment shown schematically in FIGS. 10–11. The capsule member enclosing the air/abrasive mixture chamber 62 is shown removed in the view of FIG. 12 to expose the coupling collar 102, shutter assembly 74, and respective non-occluded portions of the metering orifice 54.

EXAMPLE

In one example, the abrasive jet apparatus 40 formed in accordance with a preferred embodiment of the present invention typically exhibits the following advantages and characteristics, which are listed purely for illustrative, not limiting, purposes:

(1) Linear range
- (a) excellent linearity, enhanced with the arc edges modifications;
- (b) full analog range: from 0 to more than 1000 grams per minute;

(2) CNC controlled servomotor
- (a) encoder position feedback;
- (b) instant response (non-pneumatic);
- (c) single variable throw actuator, (avoiding open/close cylinders of prior art abrasive water jet machines);

(3) Sealed housing
- (a) internally aspirated vacuum line;
- (b) IP 67 wash down service;

(4) Wear resistant coatings and materials; and, (5) Abrasive material dispensing valve
- (a) rotary shutter motion is mechanically simple;
- (b) self-clearing action;
  - i. abrasive on shutter is centrifugally slung off;
  - ii. no abrasive accumulates near the drive shaft/guide tube clearance;
- (c) drive shaft may have an integral aspiration function (provided by the tube 76', for example).

In one example, the abrasive jet apparatus 40 formed in accordance with a preferred embodiment of the present invention is found to operate sufficiently within the following set of parametric criteria. Such parametric criteria are listed, again, purely for illustrative purposes, and the present invention is not limited thereto.

1. Environmental
   - a. Must operate in ambient conditions from 32° F. to 165° F.
   - b. Relative Humidity 0–100% over full temperature range
   - c. Dirty industrial area, characterized by abrasive dust and spray
   - d. Unit may be housed in a sealed, air purged canister (1 SCFM)
2. Physical Envelope
   - a. Present Mini-Hopper Assembly, LAI P/N 901005
   - b. Minimize envelope, especially horizontal section
3. Power Supply
   - a. 24 Vdc
   - b. ±15 Vdc
4. Abrasive
   - a. Grade
     - i. Maximum: 50 grit, HPX and HPA
     - ii. Minimum: 220 grit, HPX and HPA
   - b. Flow
     - i. Metered flow (lbs/mm) to be linear (preferred) over command range
     - ii. Maximum: Equivalent to Ø.375" metering disk.
     - iii. Minimum: Equivalent to Ø.060" metering disk.
5. Construction
   - a. Metering Vanes (Shutter Members)
     - i. The general shape may be intersecting "V" shapes (<>)
     - ii. Sections shapes may be modified to provide linearity and accuracy
     - iii. Different vane shapes/sizes permissible for different grit sizes
     - iv. Throw = .25" to .75" (minimize while meeting 1% repeatability)
   - b. Materials
     - i. Use Commercial Off The Shelf (COTS) components wherever possible -continued

- ii. Control and fixed vane must be abrasion resistant/long life
- 6. Performance
  - a. Mechanical
    - i. Dynamics
      - 1. Access time
        - a. ≦30 ms avg.
        - b. ≦50 ms full scale
      - 2. ≦10% overshoot/undershoot during position acquisition
    - ii. Failure/default position is closed
    - iii. Reliability: HIGH > ~1000 hr MTBF
    - iv. Prefer actuator in vertical position
    - v. Control vane to be non-binding
  - b. Electrical
    - i. Actuator
      - 1. Position sensor feedback: buffered output signal available
      - 2. Duty Cycle:
        - a. 25% active positioning
        - b. Continuous position hold
    - ii. Interfaced with Delta Tau controllers
    - iii. Electrical command 0–10 Vdc
      - 1. 0 Vdc closed (no power/failure state)
      - 2. 10 Vdc = maximum commanded garnet flow
    - iv. Closed loop operation
      - 1. May use Access 28 board within Delta Tau controller
      - 2. May be "smart sensor" to match position sensor output with command input voltage.

Although the present invention has been described in connection with specific forms and embodiments thereof, it will be appreciated that various modifications other than those discussed above may be resorted to without departing from the spirit or scope of the invention as defined in the appended claims. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An abrasive jet apparatus comprising:

an abrasive dispenser defining a compartment for storing a granular abrasive material and at least one metering orifice disposed in open communication therewith for dispensing the granular abrasive material;

a shutter assembly disposed adjacent said metering orifice of said abrasive dispenser, said shutter assembly including a shutter member angularly displaceable between first and second positions relative to said metering orifice, said shutter member having at least one shutter opening formed therethrough, said shutter opening being substantially fully aligned with said metering orifice in said first position and substantially fully offset therefrom in said second position; and, a position actuator operatively coupled to said shutter mechanism for reversibly displacing said shutter member to said first and second positions and a plurality of intermediate positions therebetween for occluding a selective portion of said metering orifice, whereby a flow rate of the abrasive material dispensed through said metering orifice is maintained at a predetermined level.

2. The abrasive jet apparatus as recited in claim 1, further comprising a controller operatively coupled to said position actuator for adaptively controlling said shutter member displacement.

3. The abrasive jet apparatus as recited in claim 2, further comprising a feedback unit operatively coupled between said shutter assembly and said position actuator, said position actuator being driven responsive to operation of said feedback unit position actuator to adaptively position said shutter mechanism.

4. The abrasive jet apparatus as recited in claim 3, wherein said feedback unit includes a flow sensor positioned adjacent an outlet of said dispenser housing, said flow sensor including a light emitting diode (LED) and a photodetector optically coupled thereto, the flow of said abrasive material dispensed through said metering orifice passing therebetween.

5. The abrasive jet apparatus as recited in claim 1, wherein said shutter member is disposed in coaxially displaceable manner relative to said abrasive dispenser.

6. The abrasive jet apparatus as recited in claim 5, wherein said metering orifice is formed with a first arcuate contour extending angularly about an axial reference and radially offset therefrom.

7. The abrasive jet apparatus as recited in claim 6, wherein said shutter opening of said shutter member is formed with a second arcuate contour scaled dimensionally to be greater than said first arcuate contour, whereby said shutter opening in said first position extends peripherally beyond said metering orifice.

8. The abrasive jet apparatus as recited in claim 5, further comprising a secondary arc restrictor coaxially disposed between said metering orifice and said shutter member, said secondary arc restrictor being angularly adjustable relative to said metering orifice for selectively restricting a portion of said metering orifice.

9. The abrasive jet apparatus as recited in claim 5, comprising a plurality of said metering orifices concentrically disposed in angularly offset.

10. The abrasive jet apparatus as recited in claim 1, wherein said abrasive dispenser defines a plurality of said compartments partitioned one from the other, each said compartment communicating with at least a portion of at least one said metering orifice.

11. The abrasive jet apparatus as recited in claim 1, position actuator includes a drive shaft extending axially through said abrasive dispenser, and a tubular shaft guide extending coaxially about said drive shaft for protective isolation from the abrasive material disposed in said abrasive dispenser.

12. The abrasive jet apparatus as recited in claim 11, wherein said drive shaft is tubular in contour to direct an aspirating stream of air axially therethrough for expulsion adjacent an outlet of said shutter assembly.

13. The abrasive jet apparatus as recited in claim 1, wherein said electrically driven positioning actuator includes at least one device selected from the group consisting of: servo motor, a stepper motor, and a voice coil.

14. The abrasive jet apparatus as recited in claim 1, wherein said metering orifice is contoured as an 165° arc.

15. A method of regulating a flow rate for an abrasive material dispensed in an abrasive jet apparatus, the method comprising the steps of:

a. establishing an abrasive dispenser defining a compartment for storing a granular abrasive material;

b. establishing in said abrasive dispenser at least one metering orifice disposed in open communication with said compartment for dispensing the granular abrasive material;

c. establishing a shutter member adjacent said metering orifice of said abrasive dispenser, said shutter member having at least one shutter opening formed therethrough, said shutter member being angularly displaceable between first and second positions relative to said metering orifice, said shutter opening being substantially fully aligned with said metering orifice in said first position and substantially fully offset therefrom in said second position;

d. reversibly displacing said shutter member to said first and second positions and a plurality of intermediate positions therebetween for occluding a selective portion of said metering orifice; and, e. adaptively controlling said shutter member displacement to maintain a flow rate of the abrasive material dispensed through said metering orifice at a predetermined level.

16. The method as recited in claim 15, wherein step (e) includes controlling said shutter member displacement responsive to feedback of a downstream abrasive material flow rate measurement.

17. The method as recited in claim 15, further comprising the step of partitioning said compartment of said abrasive dispenser for concurrent storage of a plurality of abrasive materials; and, the step of selectively occluding said metering orifice to dispense a selected one of said abrasive materials at a predetermined flow rate therethrough.

18. The method as recited in claim 15, wherein a driving force for actuating said reversible displacement of said shutter member is imparted by a hollow tubular drive shaft concurrently conducting a stream of air induced therethrough.

19. An abrasive jet apparatus comprising:

an abrasive dispenser defining a compartment for storing a granular abrasive material and at least one arcuate metering orifice disposed in open communication therewith for dispensing the granular abrasive material;

a shutter assembly disposed adjacent said metering orifice of said abrasive dispenser, said shutter assembly including a shutter member angularly displaceable between first and second positions relative to said metering orifice, said shutter member having at least one arcuate shutter opening formed therethrough, said shutter opening being substantially fully aligned with said metering orifice in said first position and substantially fully offset therefrom in said second position; and, a position actuator operatively coupled by a substantially tubular drive shaft member to said shutter mechanism for reversibly displacing said shutter member to said first and second positions and a plurality of intermediate positions therebetween for occluding a selective portion of said metering orifice, said drive shaft member defining an axial bore for conducting a stream of air induced therethrough, whereby a flow rate of the abrasive material dispensed through said metering orifice is maintained at a predetermined level.

20. The abrasive jet apparatus as recited in claim 19, wherein the flow rate is controlled in substantially linear proportion to manner responsive to the displacement of said shutter member at least between said intermediate positions relative to said metering orifice.

* * * * *

UNITED STATES PATENT AND TRADEMARK OFFICE

CERTIFICATE OF CORRECTION

PATENT NO. : 7,040,959 B1
APPLICATION NO. : 11/039225
DATED : May 9, 2006
INVENTOR(S) : Brian R. Panuska It is certified that error appears in the above-identified patent and that said Letters Patent is hereby corrected as shown below:

In the Title Page;

Item [73], Assignee, delete "Illumina, Inc., San Diego, CA" and insert --LAI International, Inc., Minneapolis, MN"

Signed and Sealed this

Fifteenth Day of August, 2006

JON W. DUDAS
*Director of the United States Patent and Trademark Office*